US005429356A

United States Patent [19]

Dingle et al.

[11] Patent Number: 5,429,356

[45] Date of Patent: Jul. 4, 1995

[54] GOLF PUTTER

[75] Inventors: Craig B. Dingle; William Harpell, both of Sparta, N.J.

[73] Assignee: Bill-Ding Technology, Inc., Sparta, N.J.

[21] Appl. No.: 108,920

[22] Filed: Aug. 18, 1993

Related U.S. Application Data

[63] Continuation-in-part of Ser. No. 799,276, Nov. 27, 1991, Pat. No. 5,523,869.

[51] Int. Cl.[6] ..... A63B 53/02; A63B 53/08

[52] U.S. Cl. ..... 273/80.1; 273/171; 273/194 B; 273/80.2

[58] Field of Search ..... 273/167 R, 167 A, 167 B, 273/167 C, 167 D, 167 E, 167 F, 167 G, 167 H, 167 J, 167 K, 168, 169, 170, 171, 172, 173, 174, 175, 77 R, 79, 193 R, 194 R, 194 B, 80.1–80.9; 403/83, 84, 93, 112, 364, 381

[56] References Cited

U.S. PATENT DOCUMENTS

| | | | |
|---|---|---|---|
| 1,657,972 | 1/1928 | Rowe | 273/79 |
| 2,155,830 | 4/1939 | Howard | 273/79 |
| 2,222,534 | 11/1940 | Harris | 273/79 |
| 2,715,026 | 8/1955 | Gadman | 273/171 |
| 2,932,515 | 4/1960 | May | 273/171 |
| 3,143,349 | 8/1964 | MacIntyre | 273/171 |
| 3,817,534 | 6/1974 | Carlino | 273/168 |
| 3,999,765 | 12/1976 | Bishop | 273/171 |
| 4,325,553 | 4/1982 | Taylor | 273/167 F |
| 4,423,874 | 1/1984 | Stuff | 273/171 |
| 4,519,612 | 5/1985 | Tsao | 273/163 R |
| 4,529,204 | 7/1985 | Yamakawa | 273/193 R |
| 4,540,178 | 9/1985 | Johnson | 273/169 |
| 4,655,459 | 4/1987 | Antonious | 273/171 |
| 4,695,054 | 9/1987 | Tunstall | 273/171 |
| 4,754,977 | 7/1988 | Sahm | 273/171 |
| 4,815,740 | 3/1989 | Williams | 273/80.1 |
| 4,872,684 | 10/1989 | Dippel | 273/164.1 |
| 4,895,371 | 1/1990 | Bushner | 273/164.1 |
| 5,253,869 | 10/1993 | Dingle | 273/80.2 |

FOREIGN PATENT DOCUMENTS

| | | | |
|---|---|---|---|
| 1222263 | 5/1987 | Canada | 273/80.1 |
| 9006157 | 6/1990 | European Pat. Off. | 273/80.1 |

*Primary Examiner*—Sebastiano Passaniti

*Attorney, Agent, or Firm*—Mathews, Woodbridge & Collins

[57] ABSTRACT

A golf putter having an adjustable head with at least one post extending therefrom. A plurality of annular washers are interchangeably secured to the post for changing the center of gravity of the putter head. A hub assembly attaches a shaft to the post. A novel hub locking mechanism locks the hub to the posts in which tapered male portion engages a tapered female portion. Also, a pin and groove arrangement prevents the shaft from rotating further than a predetermined angle from the vertical axis.

15 Claims, 7 Drawing Sheets

GOLF PUTTER

This application is a continuation-in-part of U.S. patent application Ser. No. 07/799,276, filed Nov. 27, 1991, now U.S. Pat. No. 5,523,869 by Craig Dingle and William Harpell entitled "Golf Putter".

BACKGROUND OF THE INVENTION

1. Field of the Invention

This invention relates to a putter apparatus including a weighted head assembly and novel hub locking assembly. The entire text and contents of which is hereby incorporated by reference into this application.

2. Description of the Related Art

According to the article on "Golf", page 506, ENCYCLOPEDIA BRITANNICA 1954 Edition:

> The putt, once the ball is on the green, is perhaps the most delicate shot in golf. The player must hit the ball along a line that allows for very little margin of error, and with enough force to roll the ball to the hole but not too far beyond, in case the hole is missed, to make the return putt difficult. And since most greens are not level, but have numerous minor pitches and slopes, great care must be taken to select the proper line, which may be quite far to one side or the other of the cup.

In the prior art, various techniques have been used to design putters for improved performance. Most of these involve inserting weights or screws into bores in the putter head in positions that may be adjustable with tools, prior to play. The prior art putters also have the disadvantage of being difficult to lock the shaft at a predetermined position.

U.S. Pat. No. 2,155,830 to Howard describes a putter including an undercut groove. A nut member is placed in the groove and a screw belt is attached thereto. The nut member provides weighting of the club.

PCT Application No. 9006157 to Osmond describes a putting assembly including a pair of spigots positioned on either end of a club head. A hose/arm is adapted to attach to one of the spigots for conversion of right or left hand use of the club. A cover slides over a weight assembly and attaches to the spigots. Osmond has the disadvantage of being difficult to change the weight of the assembly because of the difficulty in easily removing the weights from the cover.

The prior art putting assemblies have the disadvantage that altering of the weights is cumbersome and therefore difficult to perform during play.

SUMMARY OF THE INVENTION

Briefly described, the present invention comprises a golf putter with at least one post extending from the face of the putter. A hub assembly and a plurality of washers can be interchangeably attached to the posts. The washers are interposed onto the post in a preselected pattern to change the center of gravity of the putter head for producing a "sweet spot" at predetermined positions of the club face.

A novel hub locking assembly is formed of interlocking male and female members. Preferably, a tapered male portion of the hub mates with a tapered recessed female portion of the face for providing a seal. A pin and groove arrangement can be used to prevent the shaft from rotating further than a predetermined angle. A pin can be positioned in the female portion of the putter head and the hub can include at least one cylindrical groove for receiving the pin. The shaft is secured to the hub in radial relation thereto. A predetermined length of the groove is chosen in order to permit the hub to rotate until the pin engages the end of the groove, thereby the shaft rotates up to a predetermined angle from a vertical axis. An opening can be formed in the washers for engagement with the pin and for placement of the washer within the female portion of the putter face. In the alternative, the washer can have a larger diameter than the recessed portion so that a hollow space is formed between the washer and the recessed portion of the putter face for altering the feel of the club face "sweet spot".

DETAILED DESCRIPTION OF THE INVENTION

Figure 1A:
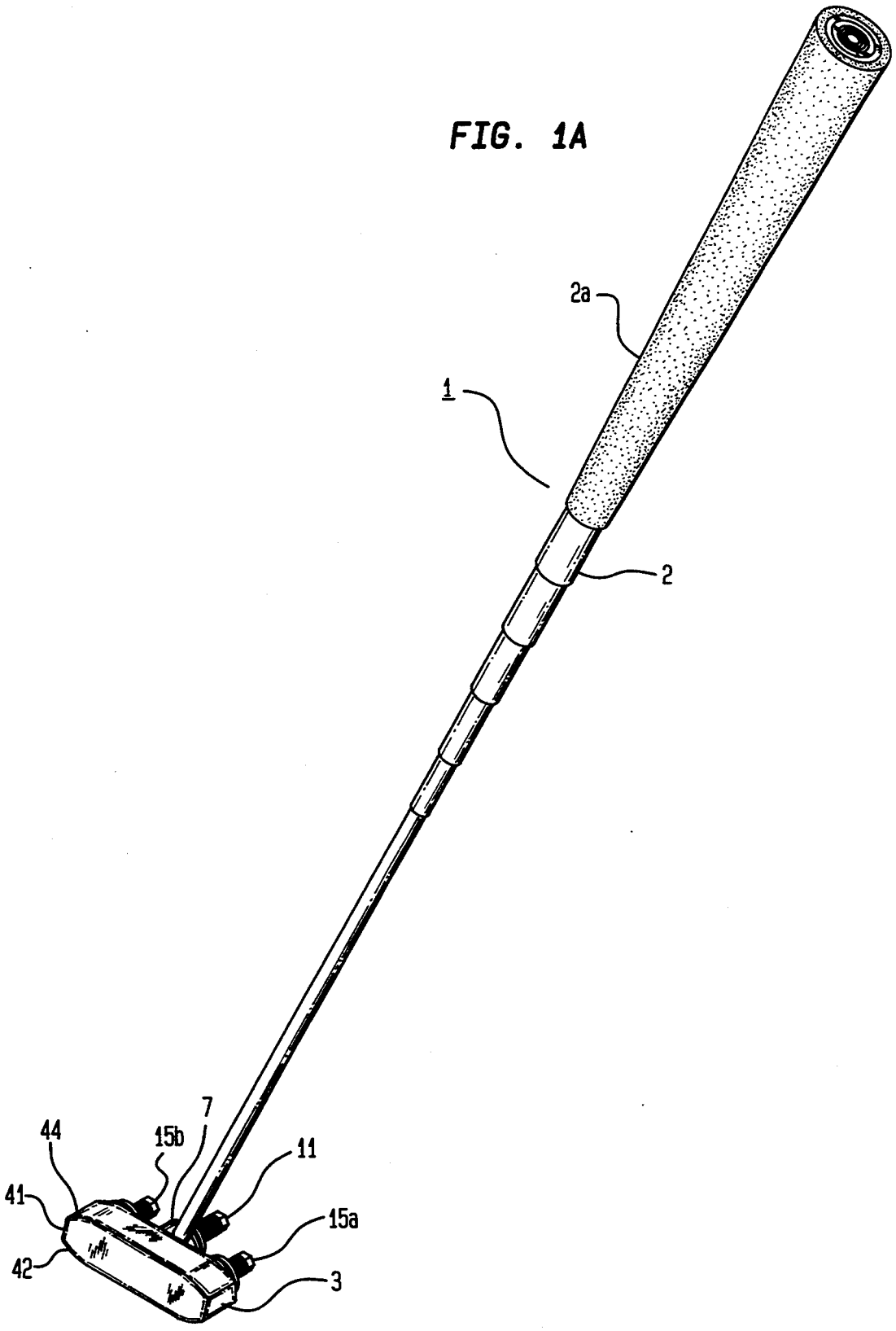
FIG. 1A is a perspective view of a golf putter including shaft and head, in accordance with the present invention.
Figure 2:
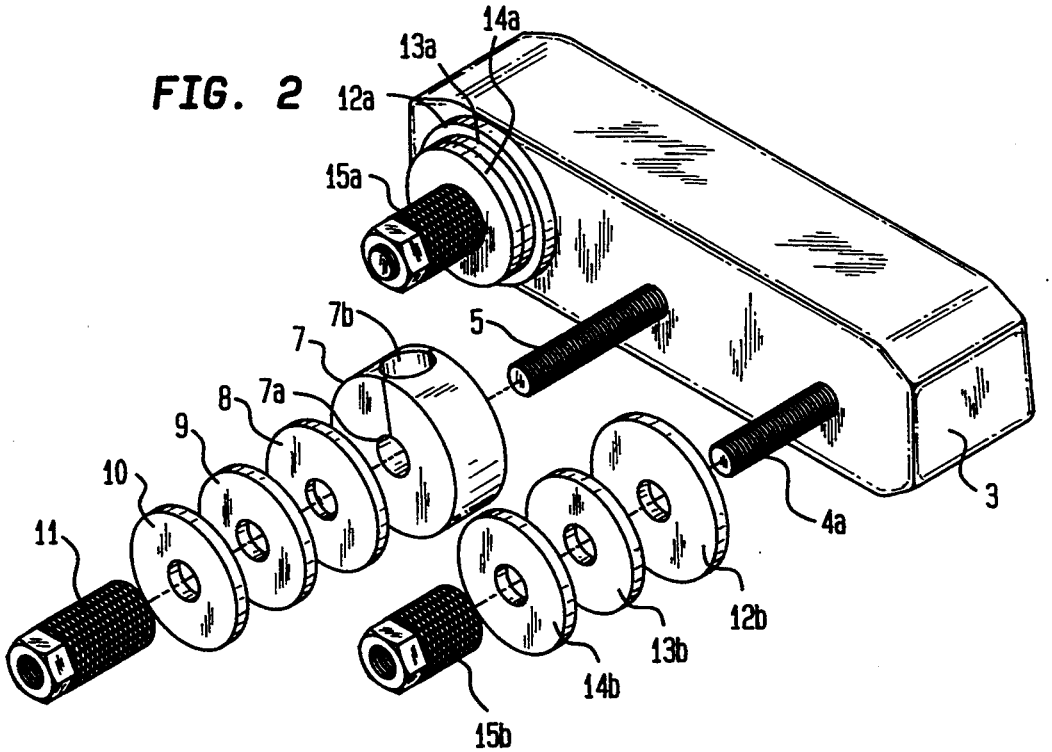
FIG. 2 is an exploded view of the putter head of FIGS. 1A and 1B with the weighted washers in the process of being assembled on the head.

During the course of this description, like numbers will be used to identify like elements according to the different figures which illustrate the invention. FIG. 1A illustrates the putter of the present invention including shaft 2. Shaft 2 can be formed of steel and can be two feet, 11 inches long, being tapered in diameter from, about, 1 inch at the upper end to about $\frac{5}{8}$ inch at the lower end. The terminal quarter inch of shaft 2 being screw-threaded or soldered or otherwise secured in normal relation to the curved side of cylindrical hub 7 through the lateral bore **7*b* as shown in FIG. 2. Preferably, annular cylindrical hub 7 is 15/16 inch in outer diameter, $\frac{3}{4}$ inch thick, and has a central bore 7*a*, $\frac{1}{4}$ inch in diameter, as well as lateral bore 7*b***, and weighs about one ounce.

The upper end of the shaft in the present embodiment is preferably encased for an axial length of about $10\frac{3}{4}$ inches with a gripping sleeve **2*a*. Gripping sleeve 2*a* is preferably formed of an elastomer, such as hard rubber or neoprene. The surface of gripping sleeve 2** is engraved with a pattern to provide a roughened hand grip.

Figure 1B:
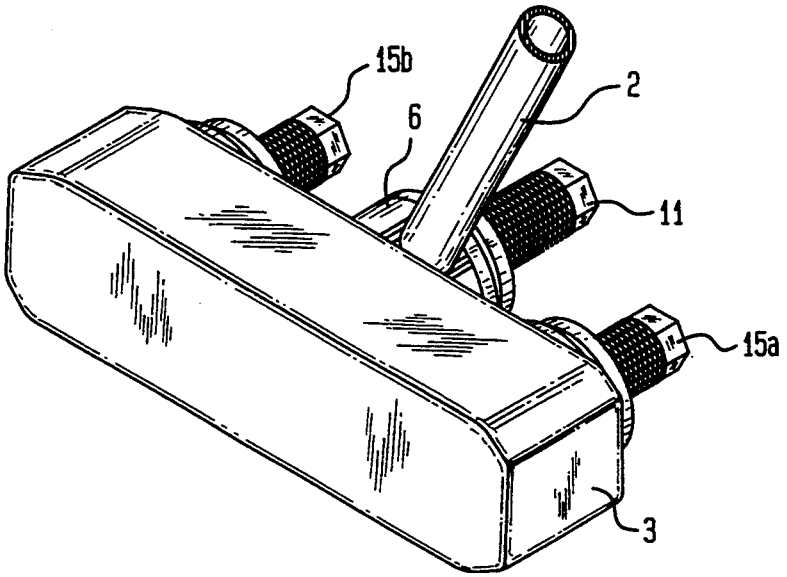
FIG. 1B is a detailed view of the putter head of FIG. 1A.

FIG. 1B is an enlarged showing from the outer end showing the ball-contacting surface, of the putter head 3, with the inner and outer surfaces substantially flat and parallel, and the ends partially rounded, so as to provide a generally elliptical shape in the principal plane of the club head. In the present embodiment putter head 3 is preferably formed of a core of stainless steel, 3½ inches in overall length, 1 inch in overall width, and 9/8 inch thick.

Preferably, three screw-threaded posts 4*a*, 5 and 4*b* (not shown, but identical to 4*a*), project normally from the inner surface of the body 3. The lateral posts 4*a* and 4*b* are ¼ inch in diameter and are each centered ½ inch in from a respective end of body 3, and each extend about 1½ inches out from the surface. The post 5 extends out normally from the center of the inner surface of body 3.

Hub 7, secured to the base of shaft 2, is interposed onto post 5 through central bore 7*a* so that it seats flat against the inner surface of the body 3. The position of shaft 2 can be rotated relative to the principal plane of the body 3, and fixed in any desired orientation thereto, as will be explained hereinafter.

FIG. 2 shows an enlarged perspective of the head 3 with the shaft removed from the hub 7, partly disassembled. It will be understood that the elements in the process of being mounted on the screw post 4*a* are substantially similar to the elements mounted on screw post 4*b* (not shown), and correspondingly numbered.

In accordance with the present invention, the center of gravity of the putter head 2 may be varied according to any desired arrangement of weights on posts 4*a*, 5 and 5*b*. In the present embodiment, the weights 8, 9 and 10, 12*a*, 12*b*, 13*a*, 13*b*, and 14*a*, 14*b* are each in the form of an annular washer of heavy metal, such as stainless steel, ⅛inch thick, and having a central bore slightly exceeding ¼ inch in diameter, which is designed to be accommodated by a respective one of the screw-threaded posts 4 or 4*a*, or 4*b*. Larger weights 8, 12*a*, and 12*b* are preferably 15/16 inch in diameter and the small weights 9, 10, and 13*a*, 13*b*, 14*a*, 14*b* are preferably ¾ inch in diameter. The small washers weigh, for example, about ¼ ounce each, whereas the larger washers weigh slightly more, say ⅓ ounce each. It will be understood that the shape, material, number and weight of the individual weights 8, 9, 10, 12*a*, 12*b*, 13*a*, 13*b* and 14*a*, 14*b*, is not limited to those shown herein by way of example, but may be varied according to any pattern desired by the user. It will also be understood that hub 7 can be attached to any one of posts 4*a*, 5 or 4*b*.

In the present described embodiment, after hub 7 has been interposed on the central opening 7*a* and set in place on the surface of the core body 3, washers 8, 9 and 10, in any combination desired, are interposed onto post 5 in contiguous relation.

Annular nut 11 mates with the screw-threaded post 15. Preferably, annular nut 11 has a ½ inch outer diameter and weighs about ¾ ounce. Annular nut 11 preferably is one inch in axial length, knurled on its lateral curved sides, and terminates at its upper end about ⅜ inch from the top. Preferably, annular nut 11 has a hex shape with flat faces, to enable nut 11 to be tightened into place with fingers or a wrench. The nuts 15*a* and 15*b* are similar, except that they can be smaller about ¾ inch long and weighing about ½ ounce each.

These elements may be threaded together in any desired combination, at the option of the user. For example, all or less than all of the washers 8, 9 and 10 may be interposed onto the post 5, and the nut 11 then tightened in place to hold all of the elements in secured, contiguous relation. The hub 7, to which the shaft 2 has been secured in the opening 7*b*, may be rotated to any desired angular position on the outer surface of body 3, and tightened in place by the nut 11.

Figure 3:
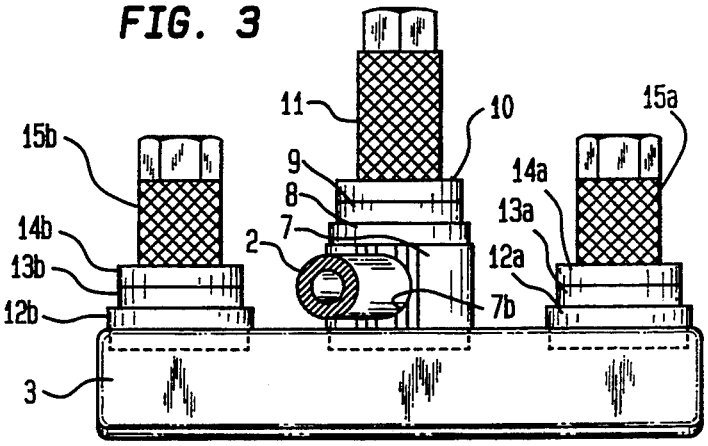
FIG. 3 is a side elevational view of the putter head of FIG. 2.
Figure 5:
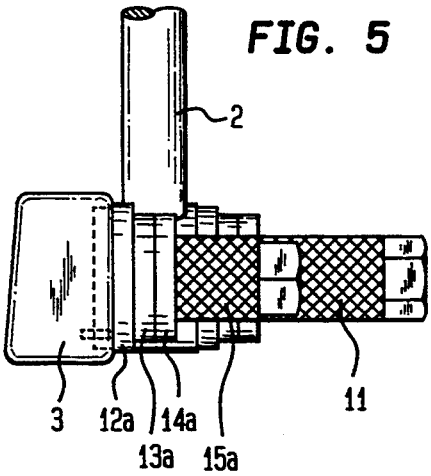
FIG. 5 is an end-elevational view of the putter head of FIG. 4.
Figure 4:
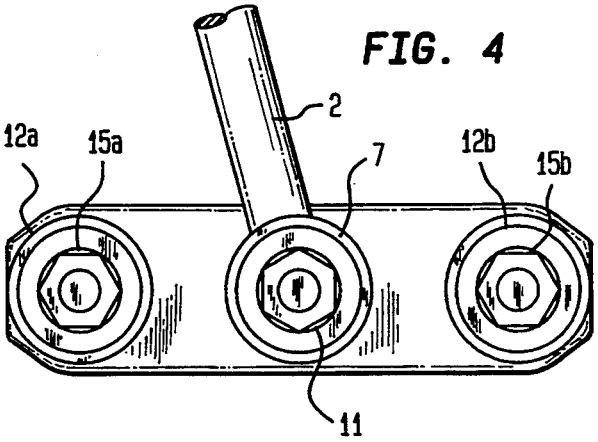
FIG. 4 is a plan view of the putter head of FIGS. 1–3 showing the adjustable connection to the shaft.

Likewise all, or less than all, of the washers 12*a*, 12*b*, 13*a*, 13*b* and 14*a*, 14*b* may be interposed onto posts 4*a* and 4*b* and tightened into contiguous relation on their respective posts by the nuts 15*a* , 15*b* as shown in FIGS. 3–5.

Figure 6:
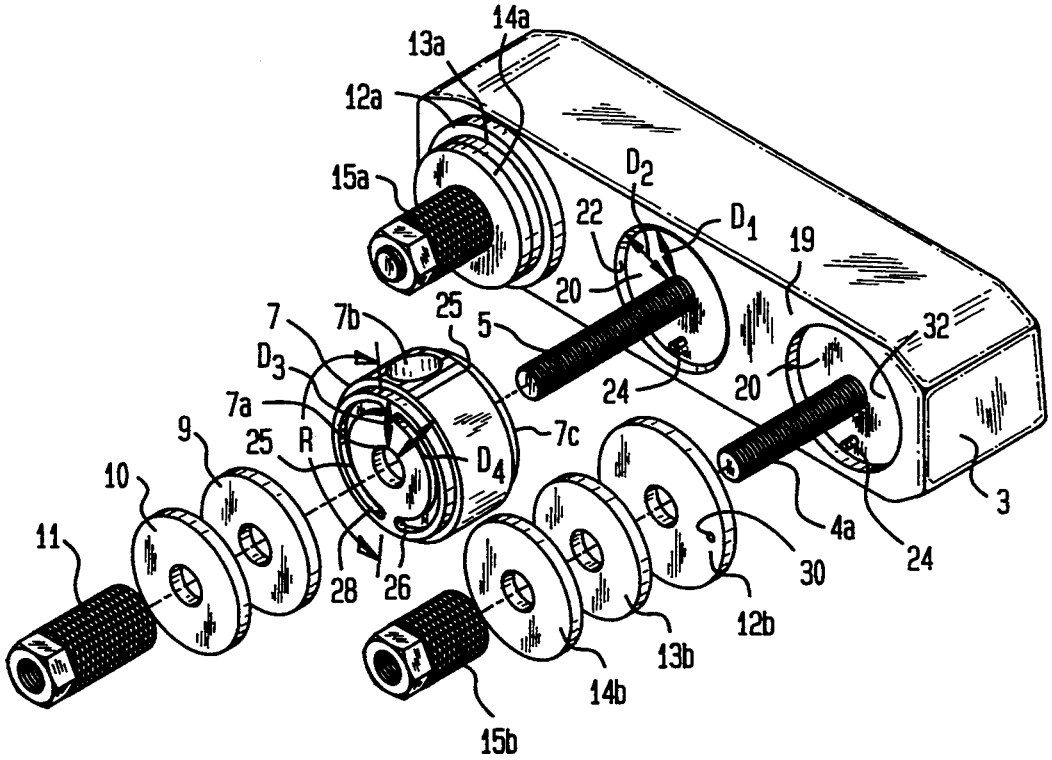
FIG. 6 is a exploded view of a second embodiment of the putter head.

FIG. 6 illustrates a modification of the invention wherein female portions 20 are formed in surface 19 of putter head 3. Female portion 20 has a larger outer diameter $D_2$ than inner diameter $D_1$. Edge 22 of female portion 20 is tapered between outer diameter $D_2$ and inner diameter $D_1$. Male portion 7*c* engages female portion 20. Male portion 7*c* has a larger outer diameter $D_4$ than inner diameter $D_3$ for mating the shape of female portion 20. Edge 25 is tapered between outer diameter $D_4$ and inner diameter $D_3$. The engagement of edge 22 of female portion 20 and edge 25 of male portion 7*c* lock hub 7 at a predetermined position, thereby locking shaft 2 at a desired angular position. The mating of edge 22 with edge 25 provides a positive lock between female portion 20 and male portion 7*c*. Annular nut 11 is tightened to engage female portion 20 with male portion 7*c*. Preferably, annular nut 11 includes a rough outer surface for manually tightening the annular nut with finger pressure.

Figure 7:
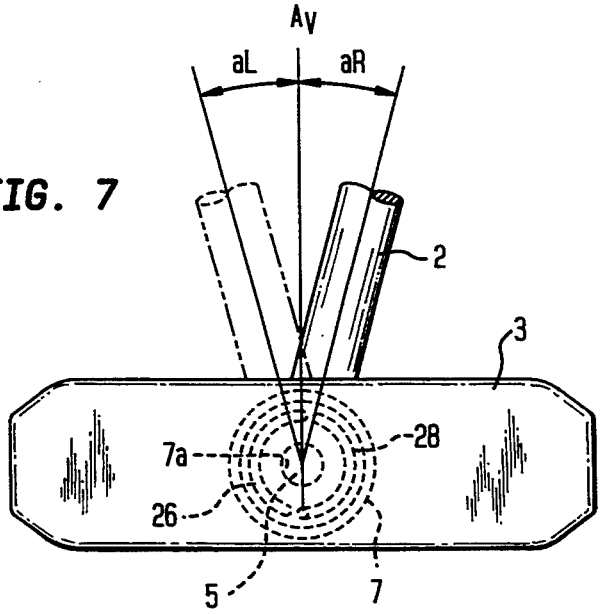
FIG. 7 is an exploded view.

Posts 4*a*, 5 and 4*b* extend outwardly from female portions 20. Pin 24 can be positioned in female portion 20. Hub 7 includes grooves 28,26 which accommodate and lock onto pin 24. Preferably, grooves 28,26 are cylindrical and have a predetermined radial length of R. Hub 7 can rotate until pin 24 engages an end of grooves 26,28 to prevent shaft 2 from rotating further than a predetermined angle aL or angle aR shown in FIG. 7. Angles aL and aR can be in the range of from about 0 to about 90 degrees. Preferably, Angle aL or Angle aR is less than 10 degrees from vertical axis aV.

Washer 12*b* can include an opening 30 to accommodate pin 24. In an alternative embodiment washer 12*b* can have a diameter larger than the diameter of female portion 20 so that a hollow space is formed between washer 12*b* and bottom surface 32 of female portion 20. The hollow space provides a different feel during contact of the ball with the putter head surface.

Figure 8:
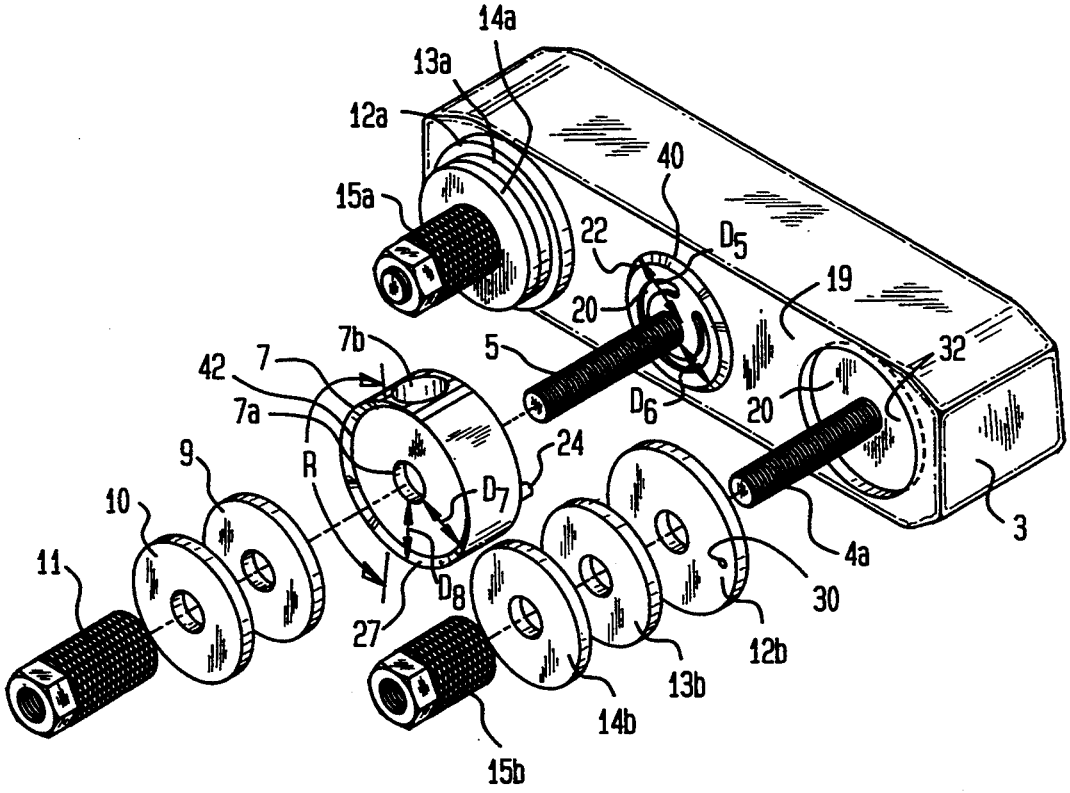
FIG. 8 is a view of the ball impacting surface of the putter head of FIG. 6 showing the angle of shaft movements.

In an alternative arrangement, male member 40 is positioned on surface 19 of putter head 3, as shown in FIG. 8. Male member 40 includes an outer diameter $D_6$ larger than inner diameter $D_5$ and edge 22 is tapered between inner diameter $D_5$ and outer diameter $D_6$. Male member 40 engages female member 42. Female member 42 has a larger outer diameter $D_8$ than inner diameter $D_7$ and edge 27 is tapered between outer diameter $D_8$ and inner diameter $D_7$. Grooves can be positioned in male member 40 and a pin can be positioned in female member 42 for preventing shafts from rotating further than predetermined angles aL and aR shown in FIG. 7.

Figure 9:
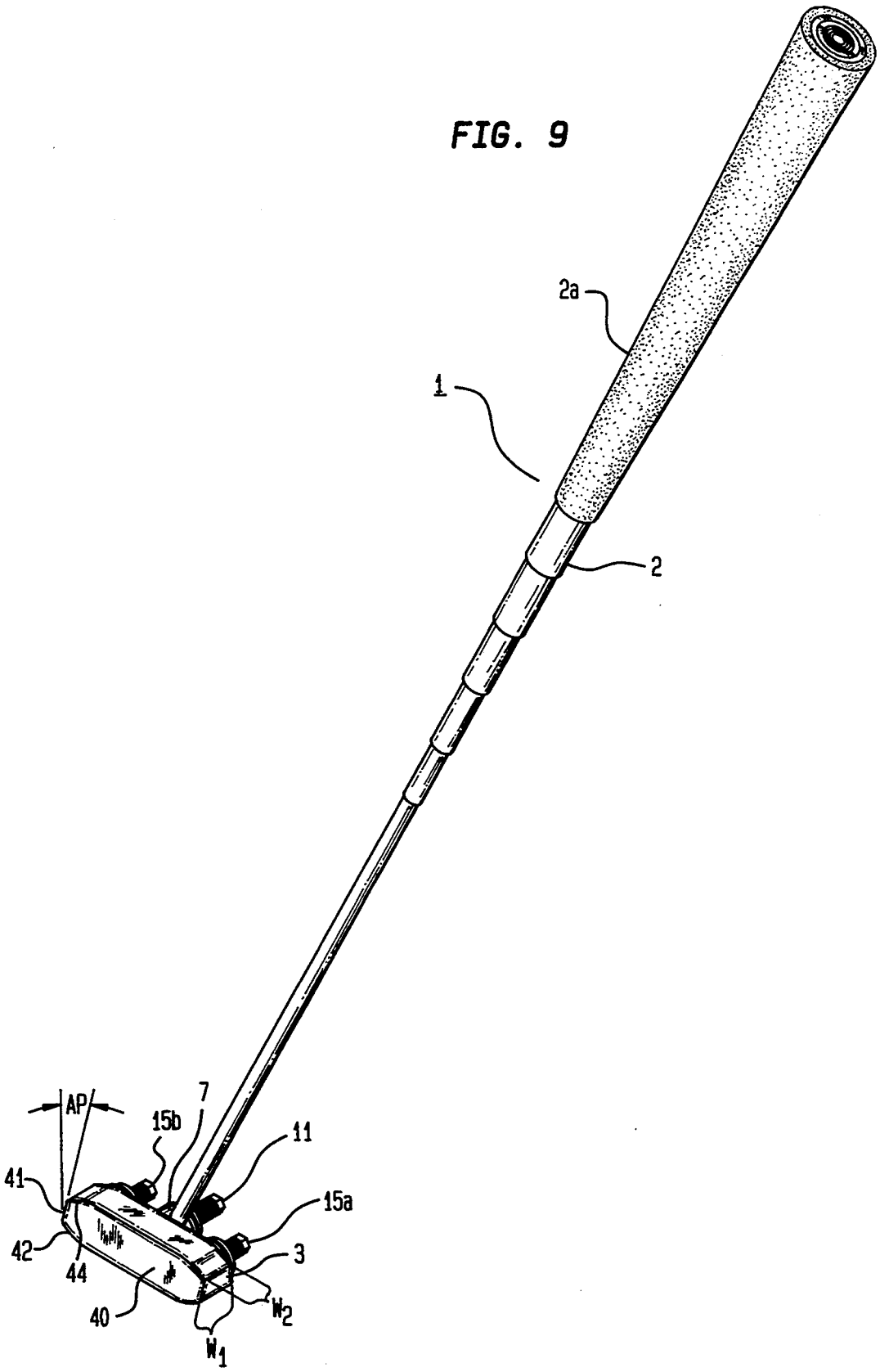
FIG. 9 is a perspective view of the golf putter including an upwardly angled putter face.
Figures 10, 11:
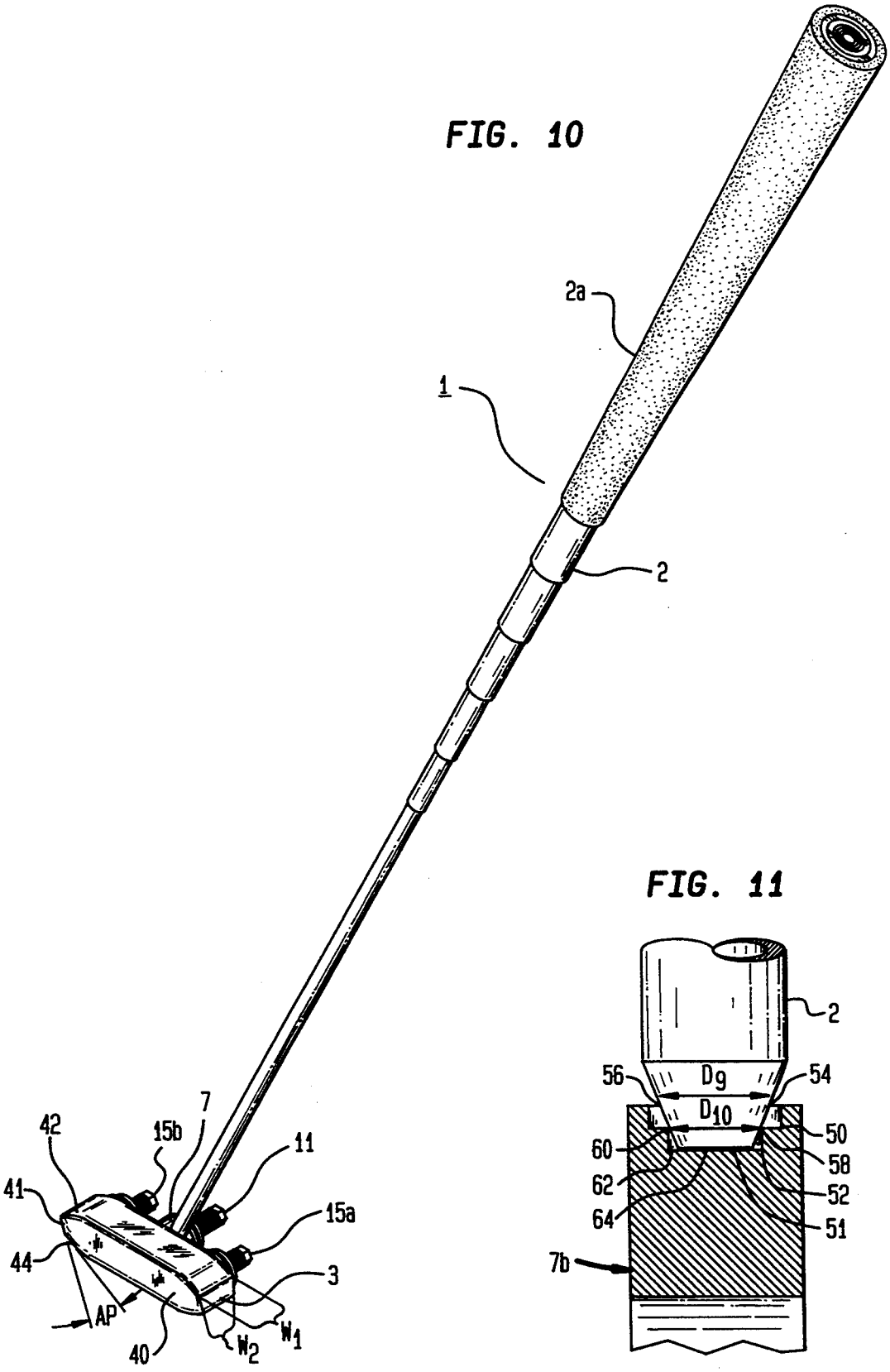
FIG. 10 is a perspective view of the golf putter including a downwardly angled putter face.
FIG. 11 is a vertical cross-section of a lateral bore of the hub for receiving a shaft of the putter.

FIG. 9 illustrates an upward angled putter face. Portion 42 of putter face 40 is positioned at the lower portion of ball contacting surface 41 and portion 44 of putter face 40 positioned at the upper portion of ball contacting surface 41. Portion 42 has a larger width $W_1$ than width $W_2$ of portion 44 for upwardly angling putter face 40 at a predetermined angle Ap. In the alternative, putter head 3 can be rotated so as to have portion 42 at the upper portion of putter face 40 and portion 44 at the lower portion of putter face 40 for downwardly angling club face 41, as shown in FIG. 10. Preferably, angle Ap is in the range of between about 0° and 6°.

FIG. 11 illustrates an embodiment of lateral bore 7b which receives shaft 2. Shaft 2 has a tapered end 51. Bore 7b includes upper bore 50 and lower bore 52. Diameter $D_9$ of upper bore 50 is larger than diameter $D_{10}$ of lower bore 52. Shaft 2 contacts bore 7b at portions 54, 56 of upper bore 50 and at portions 58 and 60 of lower bore 52 for locking shaft 2 in bore 7b. Preferably, an adhesive can be applied to reservoir 62 for adhering shaft 2 to bottom surface 64 of bore 7b.

It will be apparent that various modifications of the arrangements of the posts 5 and 4a, 4b may be employed on the surface of the body 3. For example, one or more of the posts 5, 4a, and 4b may be eliminated from the outer surface of 3 or additional posts can be added to outer surface of the body 3, or they can point in a different direction from the outer surface.

A principal advantage of the invention is that the elements of the head may be changed and tightened on the golfcourse, using the fingers, or a simple wrench, allowing the user to change the angle of the shaft, or the center of gravity of the head to suit his or her needs during play. An additional feature includes a novel hub locking assembly for locking the hub to the rear surface of the putter face. Also, a pin and groove arrangement is used to prevent an attached shaft from rotating past a predetermined angle from vertical.

It will be understood that the present invention is not limited to devices of the specific form, weight, shape or material shown and described by way of example, but only by the recitations of the appended claims.

While the invention has been described with reference to the preferred embodiment, this description is not intended to be limiting. It will be appreciated by those of ordinary skill in the art that modifications may be made without departing from the spirit and scope of the invention.

We claim:

1. A golf putter head comprising;

an elongated body portion having a substantially flat ball contacting surface and a rear surface, said rear surface including a central portion and a pair of lateral end portions on either side of said central portion, said rear surface being parallel to said ball contacting surface, at least one post fixedly attached to said rear surface portion and externally protruding outwardly in substantially normal relation to said rear surface in a direction pointed away from said ball contacting surface, an annular cylindrical hub for accommodating said post in axial relation thereto and rotatable to any predetermined position about said post;

means for securing said cylindrical hub at said predetermined position;

means for detachably securing a plurality of annular washers in external relation to said post for changing the location of the center of gravity of said putter head, wherein said annular washers are interchangeably interposed onto or detached from said post in accordance with a preselected pattern to change the location of the center of gravity of said putter head;

a shaft having a first and second end; and means for securing said first end of said shaft to said hub in radial relation to said hub wherein said means for securing said cylindrical hub includes a female tapered portion and a male tapered portion, said female tapered portion engaging said male tapered portion.

2. The golf putter head of claim 1 further comprising angles aL from vertical and means for preventing said shaft from rotating further than said angle aL and angle aR from vertical.

3. A golf putter head comprising;

an elongated body portion having a substantially flat ball contacting surface and a rear surface, said rear surface including a central portion and a pair of lateral end portions on either side of said central portion, said rear surface being parallel to said ball contacting surface, at least one post fixedly attached to said rear surface portion and externally protruding outwardly in substantially normal relation to said rear surface in a direction pointed away from said ball contacting surface, an annular cylindrical hub for accommodating said post in axial relation thereto and rotatable to any predetermined position about said post;

means for securing said cylindrical hub at said predetermined position;

means for detachably securing a plurality of annular washers in external relation to said post for changing the location of the center of gravity of said putter head, wherein said annular washers are interchangeably interposed onto or detached from said post in accordance with a preselected pattern to change the location of the center of gravity of said putter head;

a shaft having a first and second end; and means for securing said first end of said shaft to said hub in radial relation to said hub; and means for preventing said shaft from rotating further than angles aL and aR from vertical;

wherein said means for preventing said shaft from rotating includes at least one cylindrical groove in the outer surface of said hub and a pin mounted on said rear surface, wherein said groove accommodates said pin so that said shaft is rotated up to said predetermined angles aR and aL.

4. The golf putter head of claim 3 wherein said angles aL and aR are between 0° and 90°.

5. The golf putter head of claim 4 wherein said angles aL and aR are less than 10°.

6. The golf putter head of claim 5 wherein said second end of said shaft includes a hand grip.

7. The golf putter head of claim 6 wherein said means for detachably securing said plurality of annular washers comprises a screw threaded nut.

8. The golf putter head of claim 7 wherein said screw threaded nut includes a rough outer surface.

9. The golf putter head of claim 8 wherein at least one of said annular washers includes an opening for accommodating said pin.

10. The golf putter head of claim 9 wherein said female tapered portion is formed in said rear surface of said putter head and said male tapered portion is formed at one end of said hub.

11. The golf putter head of claim 10 wherein said hub includes a lateral bore for receiving said shaft.

12. The golf putter head of claim 11 wherein said lateral bore includes an upper bore portion and a lower bore portion, said upper bore portion having a larger diameter than the lower bore portion, wherein said shaft contacts said upper bore portion and said lower bore portion.

13. The golf putter head of claim 12 wherein said lower bore portion forms a reservoir between said bore and said shaft for receiving an adhesive.

14. The golf putter head of claim 13 wherein the outer diameter of said washer is larger than the outer diameter of said recessed portion of said second surface for forming a hollow space between said washer and said recessed portion.

15. The golf putter head according to claim 14 wherein said female tapered portion is formed at an end of said hub and said male tapered portion is formed in said rear surface of said putter head.

* * * * *